US008438720B2

(12) United States Patent
Muneuchi et al.

(10) Patent No.: US 8,438,720 B2
(45) Date of Patent: May 14, 2013

(54) COIL COMPONENT AND METHOD OF MANUFACTURING THE SAME

(75) Inventors: Keita Muneuchi, Tsurugashima (JP); Yusuke Kito, Tsurugashima (JP); Takeo Ohaga, Tsurugashima (JP); Hisashi Yano, Tsurugashima (JP)

(73) Assignee: Toko, Inc., Tsurugashima-Shi, Saitama-Ken (JP)

( * ) Notice: Subject to any disclaimer, the term of this patent is extended or adjusted under 35 U.S.C. 154(b) by 54 days.

(21) Appl. No.: 13/115,138

(22) Filed: May 25, 2011

(65) Prior Publication Data

US 2011/0309906 A1 Dec. 22, 2011

(30) Foreign Application Priority Data

Jun. 17, 2010 (JP) ..... 2010-138015

(51) Int. Cl.
*H01F 7/06* (2006.01)

(52) U.S. Cl.
USPC ..... 29/602.1

(58) Field of Classification Search ..... 336/65, 336/83, 96, 178, 200, 232–233; 29/602.1, 29/846, 848, 855–856
See application file for complete search history.

(56) References Cited

U.S. PATENT DOCUMENTS

| | | | | |
|---|---|---|---|---|
| 3,308,414 | A * | 3/1967 | Ostrander et al. | 336/205 |
| 4,769,900 | A * | 9/1988 | Morinaga et al. | 29/606 |
| 7,495,538 | B2 * | 2/2009 | Tsunemi et al. | 336/84 M |
| 7,541,908 | B2 * | 6/2009 | Kitahara et al. | 336/206 |
| 7,639,109 | B2 * | 12/2009 | Proehl et al. | 336/84 C |
| 2008/0252406 | A1 * | 10/2008 | Kitajima et al. | 336/83 |

FOREIGN PATENT DOCUMENTS

| | | |
|---|---|---|
| JP | 2002-50526 | 2/2002 |
| JP | 2008-53670 | 3/2008 |
| JP | 2008-205245 | 4/2008 |

OTHER PUBLICATIONS

Japanese Office Action (JP Application No. 2010-138015) of Apr. 24, 2012 with English Translation (4 pages).

* cited by examiner

*Primary Examiner* — Tuyen Nguyen
(74) *Attorney, Agent, or Firm* — Renner, Kenner, Greive, Bobak, Taylor & Weber

(57) ABSTRACT

A coil component, in which a space on an outer periphery of a winding interposed between a pair of flange portion is coated with a resin with magnetic powder, has a problem of long-term reliability that a thermosetting resin expands and contracts due to change in a temperature and the flange portions are fatigued to be broken. An object of the present invention is to provide the coil component of which core is hardly broken even when the resin with magnetic powder expands and contracts and a method of manufacturing the same. In order to solve the above-described problem, the method of manufacturing the coil component according to one embodiment of the present invention is a method of manufacturing a coil component including a drum-shaped core including a winding core portion and a pair of flange portions provided on both ends in an axial direction of the winding core portion, and a winding wound around the winding core portion, including applying a mold releasing agent for providing a gap on at least one of opposed surfaces of the pair of flange portions, winding the winding around the winding core portion, applying a resin with magnetic powder formed of a thermosetting resin to a space on an outer periphery of the winding interposed between the pair of flange portions, and thermally curing the resin with magnetic powder.

3 Claims, 3 Drawing Sheets

COIL COMPONENT AND METHOD OF MANUFACTURING THE SAME

CROSS REFERENCE TO RELATED APPLICATION

This application is based upon and claims the benefit of priority from the prior Japanese Patent Application No. 2010-138015 filed on Jun. 17, 2010 in Japan, the entire contents of which are incorporated herein by reference.

BACKGROUND OF THE INVENTION

1. Field of the Invention

The present invention relates to a coil component obtained by winding a winding around a drum-shaped core and coating the winding with a resin, and a method of manufacturing the same.

2. Related Art

The coil component obtained by winding the winding around a winding core portion of the drum-shaped core and coating a resin with magnetic powder, obtained by mixing a magnetic particle with a resin, on an outer periphery of the winding is used in a DC/DC converter of a portable electronic device and the like (for example, refer to the Japanese Patent Application Laid-Open No. 2008-205245).

Recently, with small-sizing of the electronic device, the coil component of this type has been frequently used. Since a thermal expansion rate of the resin with magnetic powder, which coats the winding, and that of the drum-shaped core are different from each other, such coil component might be fatigued by change in stress by a temperature and finally, a core thereof might be broken.

FIG. 3 is a cross-sectional view of a conventional coil component 9. A winding 5 is wound around a winding core portion 1 of a drum-shaped core 4 formed of ferrite having a pair of flange portions 2 and 3 on both ends in an axial direction of the winding core portion 1. A space on an outer periphery of the winding 5 interposed between a pair of flange portions 2 and 3 is coated with a resin with magnetic powder 6.

In such coil component, since the thermal expansion rate of the resin with magnetic powder 6, which coats the winding, and that of the drum-shaped core 4 is different from each other, the resin with magnetic powder 6 expands to serve to extend the space between the upper and lower flanges when the temperature is high and the resin with magnetic powder 6 contracts to narrow the space between the upper and lower flanges when the temperature is low. As a result, there has been a problem of long-term reliability that the flanges 2 and 3 are fatigued to be broken.

SUMMARY OF THE INVENTION

An object of the present invention is to provide a highly reliable coil component of which core is hardly broken and a method of manufacturing the same.

In order to solve the above-described problem, the method of manufacturing the coil component according to one embodiment of the present invention is a method of manufacturing a coil component including a drum-shaped core including a winding core portion and a pair of flange portions provided on both ends in an axial direction of the winding core portion, and a winding wound around the winding core portion, including applying a mold releasing agent for providing a gap on at least one of opposed surfaces of the pair of flange portions, winding the winding around the winding core portion, applying a resin with magnetic powder formed of a thermosetting resin to a space on an outer periphery of the winding interposed between the pair of flange portions, and thermally curing the resin with magnetic powder.

According to the coil component and the method of manufacturing the same according to the present invention, the gap formed by the mold releasing agent is provided between at least one of the opposed surfaces of the flange portions and the resin with magnetic powder, so that the highly reliable coil component of which core is hardly broken even when the resin with magnetic powder expands and contracts by the change in the temperature may be provided.

DETAILED DESCRIPTION OF THE INVENTION

Figure 1:
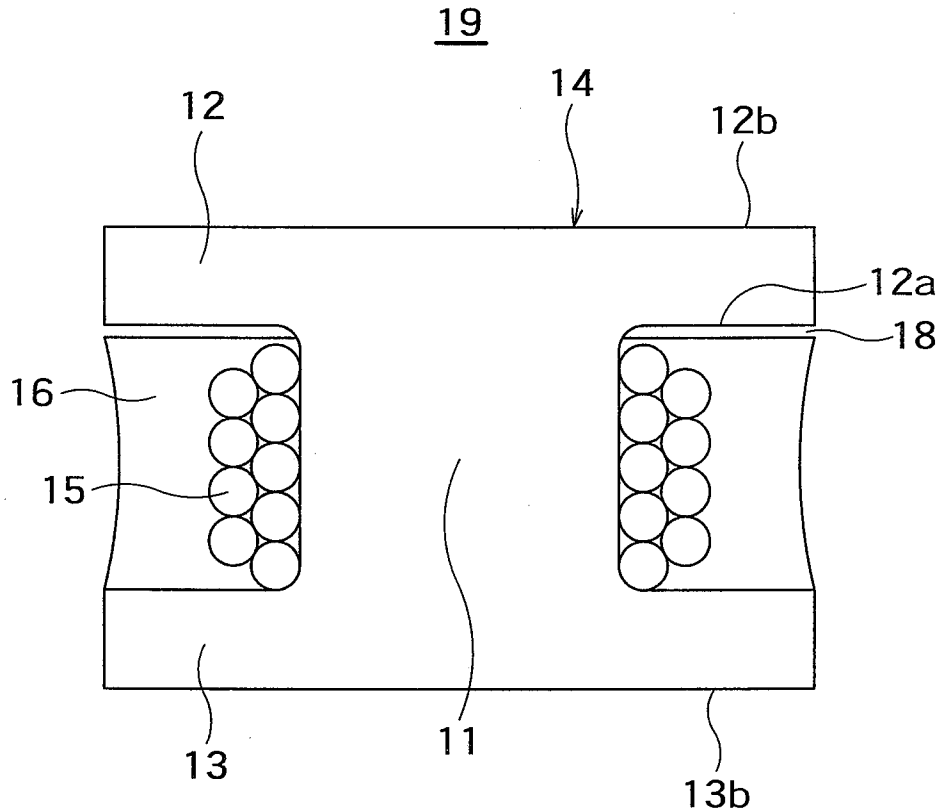
FIG. 1 is a cross-sectional view of a coil component according to one embodiment of the present invention.

FIG. 1 is a cross-sectional view of a coil component 19 according to one embodiment of the present invention. A drum-shaped core 14 has an upper flange portion 12 on an upper end in an axial direction of a winding core portion 11 and a lower flange portion 13 on a lower end in the axial direction thereof. A drum-shaped core 14 is formed of ferrite. A winding 15 is formed of an insulation-coated metal conductor line wound around the winding core portion 11.

A space on an outer periphery of the winding 15 interposed between the upper flange portion 12 and the lower flange portion 13 (a pair of flange portions) is coated with a resin with magnetic powder 16 obtained by uniformly mixing a magnetic particle into a thermosetting resin.

A gap 18 formed by a mold releasing agent is provided between a lower surface 12*a* of the upper flange portion 12 and the resin with magnetic powder 16. A pair of electrodes not illustrated are arranged on a lower surface 13*b* of the lower flange portion 13 and ends of the winding 15 are electrically connected thereto.

Figure 2:
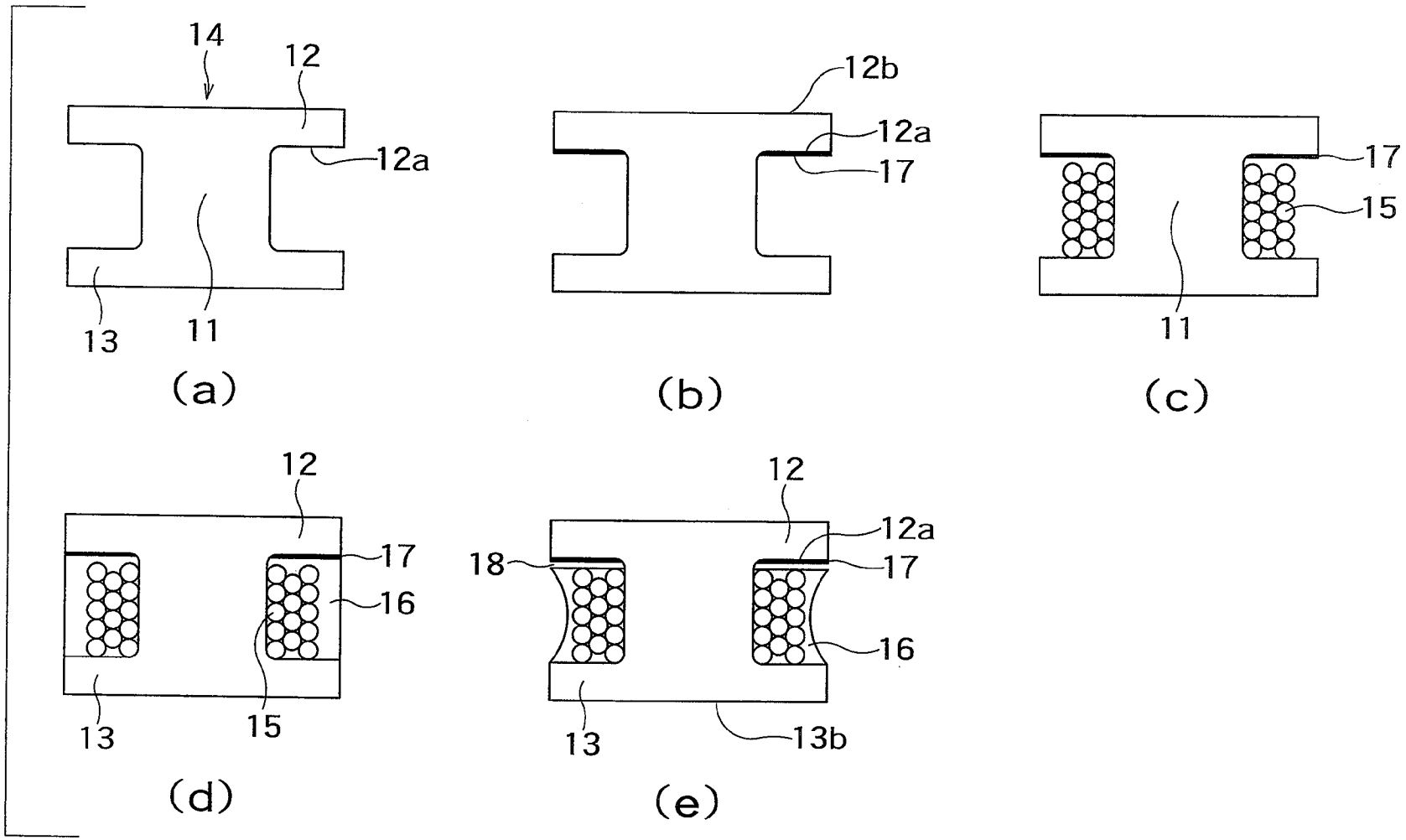
FIG. 2 is a view for illustrating a method of manufacturing the coil component according to one embodiment of the present invention.
Figure 3:
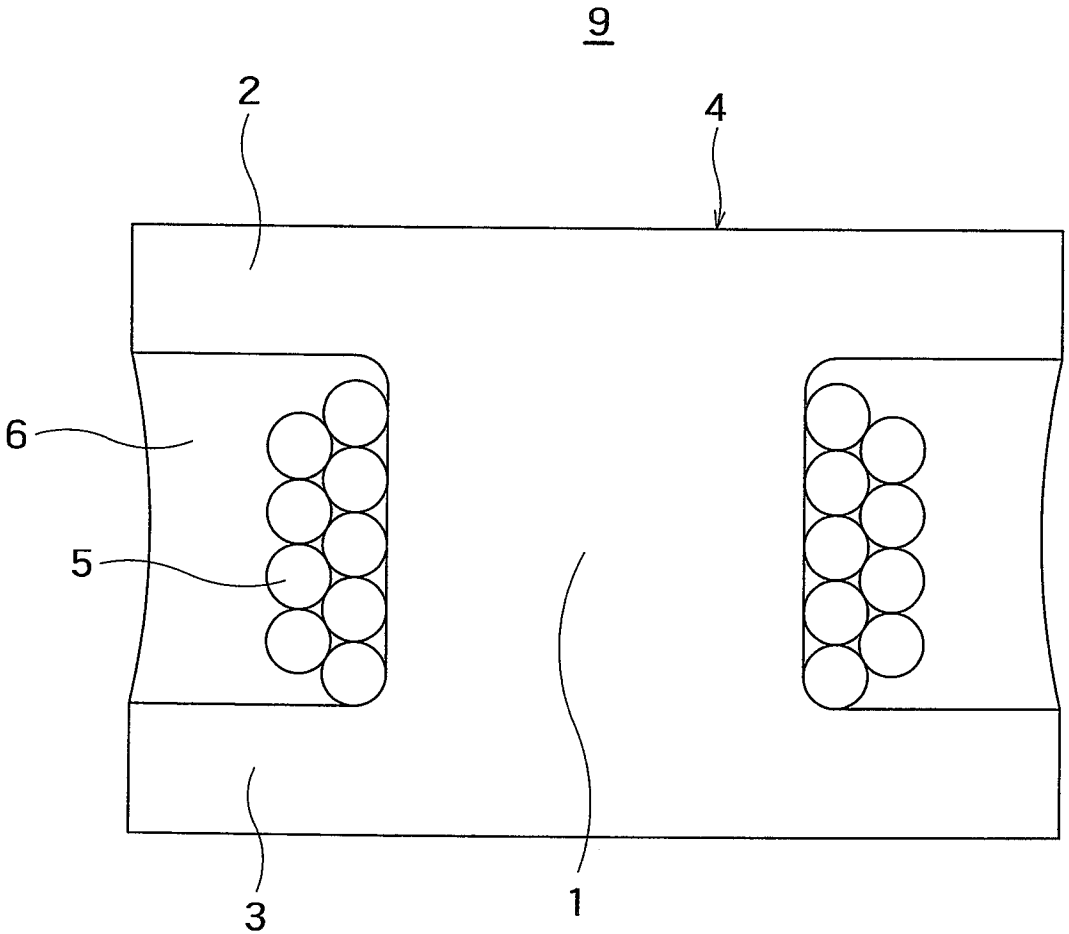
FIG. 3 is a cross-sectional view of a conventional coil component.

Hereinafter, a method of manufacturing the coil component according to one embodiment of the present invention is described with reference to FIG. 2. FIG. 2(*a*) is a cross-sectional view of the drum-shaped core 14 used in the coil component according to one embodiment of the present invention. The drum-shaped core 14 is provided with the upper flange portion 12 on the upper end in the axial direction of the winding core portion 11 and the lower flange portion 13 on the lower end in the axial direction of the winding core portion 11.

FIG. 2(*b*) is a view in which a mold releasing agent 17 is applied to an entire lower surface 12*a* of the upper flange portion 12 of the drum-shaped core 14. As the mold releasing agent 17, a fluorine-series or silicone-series mold releasing agent is used. The mold releasing agent 17 may be directly applied, or the upper flange portion 12 of the drum-shaped core 14 may be turned down to be immersed into the mold releasing agent of a prescribed depth. When immersing, if the mold releasing agent 17 adheres also to an upper surface 12*b* of the upper flange portion 12, a degree of fixity of ink of product marking is deteriorated or a vacuum absorption problem when mounting and the like is generated, so that it is also possible to immerse after adhering a masking tape to the upper surface 12*b* of the upper flange portion 12 in advance.

Next, FIG. 2(*c*) is a view in which the winding 15 is wound around the winding core portion 11 of the drum-shaped core. FIG. 2(*d*) is a view in which the resin with magnetic powder 16 is applied to the space interposed between the upper flange portion 12 and the lower flange portion 13 with a dispenser so as to cover the winding core portion 11. The resin with magnetic powder is obtained by uniformly mixing the magnetic particle into the resin, and the resin is formed of the thermosetting resin such as an epoxy resin, a phenol resin, a polyurethane resin or a polyimide resin, and the magnetic particle is formed of a ferrite-series or metal-series soft magnetic material, for example. Then, the resin with magnetic powder 16 is heated for 1 hour at 150° C. to be thermally cured.

In general, the thermosetting resin expands in volume when being heated to a curing temperature and contracts in volume when being cured from a liquid state to a solid state (reactive contraction). As a result, the volume of the thermosetting resin at a normal temperature after being cured is smaller than that before being cured.

Therefore, in the coil component according to one embodiment of the present invention, which is obtained by applying the mold releasing agent 17 to the lower surface 12*a* of the upper flange portion 12 and thereafter curing the thermosetting resin, the lower surface 12*a* of the upper flange portion and the resin with magnetic powder 16 are separated by the reactive contraction of the thermosetting resin and the gap 18 formed by the mold releasing agent is formed as illustrated in FIG. 2(*e*).

Next, the ends of the winding 15 are electrically connected to a pair of electrodes, not illustrated, arranged on the lower surface 13*b* of the lower flange portion 13. The electrodes may be provided by burning silver paste in advance or may be provided by bonding a metal plate.

In the coil component thus obtained, although a clearance of the gap 18 becomes smaller at a temperature higher than the normal temperature, the resin with magnetic powder does not push the flange portion to be expanded. On the other hand, when the temperature is lower than the normal temperature, the clearance of the gap 18 becomes larger.

Therefore, even when the resin with magnetic powder 16 expands and contracts due to change in the temperature, stress is not applied to the flange portion 12 due to the gap 18, so that the core is not broken. Also, the stress to the flange portion 12 is not applied by the temperature, change in an inductance value by the change in the temperature is small.

A temperature shock test at −40° C. for 30 minutes and at 105° C. for 30 minutes was performed for 10 coil components obtained by the above-described method of manufacturing and 10 conventional coil components. Meanwhile, a silicone-series mold releasing agent R-101 of RESINOUS KASEI CO., Ltd. was used as the mold releasing agent. As a result, the flange portion of 4 coil components were broken in 12 cycles and that of 8 coil components were broken in 24 cycles for the conventional coil components. However, the coil component according to one embodiment of the present invention was not broken in 120 cycles.

Meanwhile, when there is a gap in a magnetic path, the inductance value of the coil component decreases. However, in general, relative magnetic permeability of the resin with magnetic powder is smaller than relative magnetic permeability of the ferrite used in the core, and the clearance of the gap is significantly small, so that this practically does not affect a property of the coil component.

The resin with magnetic powder may be cured at a temperature higher than a specification temperature of the coil component in order to always prevent the stress from being applied to the flange portion within a specification temperature range.

Although the mold releasing agent is applied only to one of opposed surfaces of a pair of flange portions in the above-described embodiment, this may be applied to both surfaces.

The invention claimed is:

1. A method of manufacturing a coil component comprising a drum-shaped core including a winding core portion and a pair of flange portions provided on both ends in an axial direction of the winding core portion, and a winding wound around the winding core portion, comprising:

applying a mold releasing agent on at least one of opposed surfaces of the pair of flange portions;

winding the winding around the winding core portion;

applying a resin with magnetic powder formed of a thermosetting resin to a space on an outer periphery of the winding interposed between the pair of flange portions so as not to form a gap between the pair of flange portions; and thermally curing the resin with magnetic powder, so that the surface of the flange portion where the mold releasing agent is applied and the resin with magnetic powder are separated by a contraction of the resin with magnetic powder, so that a gap is formed.

2. The method of manufacturing the coil component according to claim 1, wherein a temperature at which the resin with magnetic powder is thermally cured is higher than a specification temperature of the coil component.

3. A coil component manufactured by the manufacturing method according to claim 1.

* * * * *